US010741116B2

(12) United States Patent
Ding et al.

(10) Patent No.: US 10,741,116 B2
(45) Date of Patent: Aug. 11, 2020

(54) METHOD AND DEVICE FOR DETERMINING GAMMA PARAMETERS AND DISPLAYING METHOD

(71) Applicants: Kunshan New Flat Panel Display Tech. Cr. Co., Ltd., Jiangsu (CN); Kunshan Go-Visionox Opto-Electronics Co., Ltd., Jiangsu (CN)

(72) Inventors: Liwei Ding, Jiangsu (CN); Xiuqi Huang, Jiangsu (CN); Xiaoyu Gao, Jiangsu (CN)

(73) Assignees: Kunshan New Flat Panel Display Tech. Cr. Co. Ltd., Jiangsu (CN); Kunshan Go-Visionox Opto-Electronics Co., Ltd., Jiangsu (CN)

( * ) Notice: Subject to any disclaimer, the term of this patent is extended or adjusted under 35 U.S.C. 154(b) by 0 days.

(21) Appl. No.: 16/179,706

(22) Filed: Nov. 2, 2018

(65) Prior Publication Data

US 2019/0073935 A1 Mar. 7, 2019

Related U.S. Application Data

(63) Continuation-in-part of application No. 15/103,990, filed as application No. PCT/CN2014/094113 on Dec. 17, 2014, now abandoned.

(30) Foreign Application Priority Data

Dec. 18, 2013 (CN) ..... 2013 1 0698460

(51) Int. Cl.
*G09G 3/20* (2006.01)
*G09G 5/02* (2006.01)
(Continued)

(52) U.S. Cl.
CPC ..... *G09G 3/2003* (2013.01); *G09G 3/3225* (2013.01); *G09G 5/02* (2013.01);
(Continued)

(58) Field of Classification Search
CPC .... G09G 3/006; G09G 3/2003; G09G 3/3406; G09G 3/3225; G09G 3/3607;
(Continued)

(56) References Cited

U.S. PATENT DOCUMENTS 7,193,637 B2 3/2007 Kudo et al.
2005/0212736 A1* 9/2005 Lu ..... G09G 3/3611 345/87
(Continued)

FOREIGN PATENT DOCUMENTS

CN 1902906 1/2007
CN 200966122 10/2007
(Continued)

OTHER PUBLICATIONS

Anonymous:"Contrast-Lagom LCD test", Mar. 27, 2008, 2 pages.
(Continued)

*Primary Examiner* — Roberto W Flores
(74) *Attorney, Agent, or Firm* — Seyfarth Shaw LLP

(57) ABSTRACT

The present invention relates to method and device for determining Gamma parameters and displaying method for a display. A method for determining Gamma parameters for a display includes: setting brightness of the display; lightening a standard image of gradient tricolor under the brightness; calibrating the displaying of the standard image of gradient tricolor with multiple different Gamma values; obtaining the optimal Gamma parameters for the tricolor based on the calibration results; and storing the optimal Gamma parameters for the tricolor corresponding to the brightness in a display chip. The method for determining
(Continued)

Gamma parameters for a display calibrates the displaying of the standard image of gradient tricolor with multiple different Gamma values, which can obtain the optimal displaying results based on different calibration results. The optimal Gamma parameters for the tricolor corresponding to the brightness, which represent the optimal displaying results, are obtained based on the calibration results.

14 Claims, 12 Drawing Sheets

(51) Int. Cl.
*G09G 3/3225* (2016.01)
*G09G 3/36* (2006.01)

(52) U.S. Cl.
CPC ... *G09G 3/3607* (2013.01); *G09G 2320/0276* (2013.01); *G09G 2320/0626* (2013.01); *G09G 2320/0666* (2013.01); *G09G 2320/0673* (2013.01); *G09G 2320/0693* (2013.01)

(58) Field of Classification Search
CPC ..... G09G 2320/02; G09G 2320/0233–0242; G09G 2320/0271; G09G 2320/0276; G09G 2320/0285; G09G 2320/029; G09G 2320/0295; G09G 2320/04; G09G 2320/06; G09G 2320/0626; G09G 2320/0646; G09G 2320/066; G09G 2320/0666; G09G 2320/0673; G09G 2320/0686; G09G 2320/0693; G09G 2320/08; H04N 9/69; H04N 5/202
See application file for complete search history.

(56) References Cited

U.S. PATENT DOCUMENTS

2006/0044242 A1* 3/2006 Park ..... G09G 3/3648 345/89
2006/0164355 A1* 7/2006 Kim ..... G09G 3/3648 345/89
2006/0284898 A1* 12/2006 Shen ..... G09G 3/006 345/690
2007/0070092 A1 3/2007 Oh et al.
2007/0279344 A1* 12/2007 Kimura ..... G09G 3/2022 345/77
2011/0134160 A1 6/2011 Okishiro et al.
2013/0093656 A1 4/2013 Wang
2013/0249955 A1 9/2013 Kim et al.
2018/0197504 A1* 7/2018 Xiao ..... G09G 5/02
2019/0051235 A1* 2/2019 Zhang ..... H04N 1/60

FOREIGN PATENT DOCUMENTS

CN 101727868 6/2010
CN 101739973 6/2010
CN 101763802 6/2010
CN 101840689 9/2010
CN 101840689 6/2013
JP 2001222264 8/2001
JP 2008158215 7/2008
JP 201172009 9/2011
TW 583624 4/2004
WO 2005064915 7/2005

OTHER PUBLICATIONS

First Office Action for European Patent Application No. 14872575.7, dated May 3, 2018, 5 pages.
Second Office Action for European Patent Application No. 14872575.7, dated Jan. 15, 2019, 9 pages.
International Search Report and Written Opinion for Application No. PCT/CN2014/094113 dated Mar. 23, 2015, 3 pages.
First Office Action for Priority Chinese Patent Application No. 201310698460.1 dated Nov. 8, 2016, 13 pages.
Second Office Action for Priority Chinese Patent Application No. 201310698460.1 dated May 24, 2017, 9 pages.
Office Action for Korean Patent Application No. 10-2016-7018492 dated Jul. 27, 2017, 9 pages.
Office Action (Notice of Grounds for Rejection) for Japanese Patent Application No. 2016-541337 dated May 9, 2017, 4 pages.
The extended European Search Report and Written Opinion for European Patent Application No. 14872575.7,dated Apr. 18, 2017, 9 pages.
David L Macadaai et al, Specification of Small Chromaticity Differences*t, J. Opt. Soc. Am. Opt. Soc. Am. J. Opt. Soc. Am, Jan. 1, 1943 (Jan. 1, 1943), pp. 247-274, XP055593443, Retrieved from the Internet: URL:https://www.osapublishing.org/DirectPDFAccess/2424866F-E085-DC93-9B95A43A7E1BE457_77522/josa-33-1-18.pdf?da=1&id=77522&seq=0&mobile=no.
Supplementary Search Report for Application No. 2013106984601 dated Dec. 18, 2013, 1 page.
Search Report for Application No. 2013106984601 dated Dec. 18, 2013, 1 page.
Office Action translation for Taiwan Application No. 103144246, 1 page.

* cited by examiner

| Brightness | Gamma=1.8 | | | Gamma=1.9 | | | Gamma=2.0 | | | Gamma=2.1 | | |
|---|---|---|---|---|---|---|---|---|---|---|---|---|
| | R | G | B | R | G | B | R | G | B | R | G | B |
| 250 | 20 | 20 | 22 | 18 | 18 | 20 | 16 | 16 | 18 | 14 | 14 | 16 |
| 300 | 18 | 18 | 20 | 16 | 16 | 18 | 14 | 14 | 16 | 12 | 12 | 4 |
| 350 | 9 | 9 | 11 | 8 | 8 | 10 | 7 | 7 | 9 | 6 | 6 | 8 |
| 400 | 8 | 8 | 10 | 7 | 7 | 9 | 6 | 6 | 8 | 5 | 5 | 7 |
| 450 | 7 | 7 | 9 | 6 | 6 | 6 | 5 | 5 | 7 | 4 | 4 | 6 |

| Brightness | Gamma=2.2 | | | Gamma=2.3 | | | Gamma=2.4 | | | Gamma=2.5 | | |
|---|---|---|---|---|---|---|---|---|---|---|---|---|
| | R | G | B | R | G | B | R | G | B | R | G | B |
| 250 | 12 | 12 | 14 | 10 | 10 | 12 | 8 | 8 | 10 | 6 | 6 | 8 |
| 300 | 10 | 10 | 12 | 8 | 8 | 10 | 6 | 6 | 8 | 4 | 4 | 6 |
| 350 | 5 | 5 | 7 | 4 | 4 | 6 | 3 | 3 | 5 | 2 | 2 | 4 |
| 400 | 4 | 4 | 6 | 3 | 3 | 5 | 2 | 2 | 4 | 1 | 1 | 3 |
| 450 | | | | | | | | | | | | |

METHOD AND DEVICE FOR DETERMINING GAMMA PARAMETERS AND DISPLAYING METHOD

CROSS REFERENCE TO RELATED APPLICATION

This application is a continuation-in-part of U.S. patent application Ser. No. 15/103,990, filed on Jun. 13, 2016, which is a 35 USC § 371 U.S. national stage filing of International Patent Application No. PCT/CN2014/094113 filed on Dec. 17, 2014, and claiming priority under the Paris Convention to Chinese Patent Application No. CN 201310698460.1 filed on Dec. 18, 2013, all of which are incorporated herein by reference for all that they teach and disclose without exclusion of any portion thereof.

TECHNICAL FIELD

The present invention relates to the field of display technology, and more particularly, to a method and device for determining Gamma parameters, and a displaying method for a display.

BACKGROUND

Traditional liquid crystal display (LCD) screen bodies are widely applied in electronic products. In order to display, a LCD screen changes the twist angle of the liquid crystal and transmits the display lights from a backlight. The NTSC (National Television Standards Committee) color gamut of a LCD screen body is usually around 45%~80%. The spectrum of light from the backlight has great impact on the NTSC color gamut of the LCD screen body. There is a conventional Gamma standard for a LCD screen body, such as Gamma=2.2 and Gamma=2.0. It leans to be a warm tone with a relatively lower color temperature in Asian regions, while it leans to be a cold tone with a relatively higher color temperature in European regions.

An active-matrix-organic-light-emitting diode (AMOLED) display screen can have a NTSC color gamut of up to 100% or more. The Gamma parameters of a LCD screen body cannot be applied to an AMOLED display screen body because of the intrinsic differences between them. Some AMOLED displays may display a NTSC color gamut of 100% or more without achieving better displaying results visually.

SUMMARY

It is necessary to provide method and device for determining Gamma parameters as well as displaying method and device for a display that may fully represent the high-quality image of the display body.

A method for determining Gamma parameters for a display is disclosed, which may include:

setting a brightness of the display;

lightening a standard image of a gradient tricolor under the brightness;

calibrating the displaying of the standard image of the gradient tricolor with multiple different Gamma values;

obtaining optimal Gamma parameters for a tricolor corresponding to the brightness based on the calibration results by recording a number of invisible gradient lines in the standard image of the gradient tricolor under each of the Gamma values wherein the invisible gradient line is determined by using image analysis, and determining the optimal Gamma parameters for the tricolor based on a pre-set number of invisible gradient lines; and storing the optimal Gamma parameters for the tricolor corresponding to the brightness in a display chip.

In one of the embodiments, the standard image of the gradient tricolor is an image showing each color of red, green and blue as a strip having brightness from 0 to 255 in sequence.

In one of the embodiments, the standard image of the gradient tricolor may include a plurality of strips having different brightness values, and the image analysis may include:

acquiring an observed image of the standard image of the gradient tricolor displayed on the display;

detecting the brightness value of each of the plurality of strips of the observed image;

determining a brightness difference between the brightness value of one strip of the plurality of strips of the observed image and the brightness value of an adjacent strip of the one strip;

comparing the brightness difference to a predetermined threshold value; and defining a border line between the one strip and the adjacent strip as the invisible gradient line when the brightness difference is less than the predetermined threshold value.

In one of the embodiments, the predetermined threshold value is equal to or less than 5 cd/m$^2$.

In one of the embodiments, the step of lightening a standard image of the gradient tricolor under the brightness may include:

determining a grayscale brightness of each pixel;

determining a grayscale voltage based on the grayscale brightness;

conducting program compiling based on the grayscale voltage; and lightening the standard image of the gradient tricolor based on the program.

In one of the embodiments, the step of obtaining the optimal Gamma parameters for the tricolor based on the calibration results may include:

recording the number of invisible gradient lines in the standard image of gradient tricolor under each Gamma value; and determining the optimal Gamma parameters for the tricolor based on a pre-set number of invisible gradient lines.

In one of the embodiments, the step of determining the optimal Gamma parameters for the tricolor based on the pre-set number of invisible gradient lines may include setting Gamma values corresponding to the standard image of the gradient tricolor in which the number of invisible gradient lines is equal to or less than the pre-set number of invisible gradient lines as the optimal Gamma parameters for the tricolor.

In one of the embodiments, the display brightness may be set as 250 cd/m2, 300 cd/m2, 350 cd/m2, 400 cd/m2, and 450 cd/m2, respectively; the multiple different Gamma values may be set as 1.8, 1.9, 2.0, 2.1, 2.2, 2.3, 2.4, and 2.5 under each brightness, respectively; and, the pre-set number of invisible gradient lines may be 6.

A device for determining Gamma parameters for a display is provided, which may include:

a brightness setting unit, configured to set the brightness of the display;

a first lightening unit for a standard image of a gradient tricolor, configured to lighten a standard image of gradient tricolor under the brightness;

a calibration unit, configured to calibrate the display of the standard image of gradient tricolor with multiple different Gamma values;

an obtaining unit for optimal Gamma parameters, configured to obtain the optimal Gamma parameters for the tricolor corresponding to the brightness based on the calibration results; and a storage unit for optimal Gamma parameters, configured to store the optimal Gamma parameters for the tricolor corresponding to the brightness in a display chip.

In one of the embodiments, the standard image of gradient tricolor may be an image showing each color of red, green and blue as a strip having brightness from 0 to 255 in sequence.

In one of the embodiments, the standard image of the gradient tricolor may include a plurality of strips having different brightness values, and the recording unit for invisible gradient lines may further include:

an acquiring unit, configured to acquire an observed image of the standard image of the gradient tricolor displayed on the display;

a detection unit, configured to detect the brightness value of each of the plurality of strips of the observed image;

a brightness difference determination unit, configured to determine a brightness difference between the brightness value of one strip of the plurality of strips of the observed image and the brightness value of an adjacent strip of the one strip;

a comparing unit, configured to compare the brightness difference to a predetermined threshold value; and a border line determination unit, configured to define a border line between the one strip and the adjacent strip as the invisible gradient line when the brightness difference is less than the predetermined threshold value.

In one of the embodiments, the first lightening unit for a standard image of a gradient tricolor may include:

a grayscale brightness determination unit, configured to determine the grayscale brightness of each pixel;

a grayscale voltage determination unit, configured to determine the grayscale voltage based on the grayscale brightness;

a program compiling unit, configured to conduct program compiling based on the grayscale voltage; and a second lightening unit, configured to lighten the standard image of gradient tricolor based on the program.

In one of the embodiments, the obtaining unit for optimal Gamma parameters for the tricolor may include:

a recording unit for invisible gradient lines, configured to record the number of invisible gradient lines in the standard image of gradient tricolor under each Gamma value; and an optimal Gamma parameter determination unit, configured to determine the optimal Gamma parameters for the tricolor based on a pre-set number of invisible gradient lines.

In one of the embodiments, the optimal Gamma parameter determination unit for the tricolor may set the optimal Gamma parameters for the tricolor to be the Gamma values corresponding to the standard image of gradient tricolor in which the number of invisible gradient lines is equal to or less than the pre-set number of invisible gradient lines.

A displaying method for a display is provided, which may include:

obtaining the brightness of the display;

obtaining optimal Gamma parameters for a tricolor corresponding to the brightness from a display chip, wherein the optimal Gamma parameters for the tricolor corresponding to the brightness are determined based on a number of invisible gradient lines in a standard image of a gradient tricolor recorded using image analysis; and calibrating the displaying of the display based on the optimal Gamma parameters for the tricolor.

In one of the embodiments, the step of determining the optimal Gamma parameters for the tricolor corresponding to the brightness based on the number of invisible gradient lines in the standard image of gradient tricolor may include:

lightening the standard image of gradient tricolor under the brightness;

calibrating the displaying of the standard image of gradient tricolor with multiple different Gamma values;

obtaining optimal Gamma parameters for a tricolor corresponding to the brightness based on the calibration results by recording a number of invisible gradient lines in the standard image of the gradient tricolor under each of the Gamma values wherein the invisible gradient line is determined by using image analysis, and determining the optimal Gamma parameters for the tricolor based on a pre-set number of invisible gradient lines; and storing the optimal Gamma parameters for the tricolor corresponding to the brightness in a display chip.

In one of the embodiments, the step of obtaining the optimal Gamma parameters for the tricolor corresponding to the brightness based on the calibration results may include:

recording the number of invisible gradient lines in the standard image of gradient tricolor under each Gamma value; and determining the optimal Gamma parameters for the tricolor based on a pre-set number of invisible gradient lines.

In one of the embodiments, the standard image of gradient tricolor may be an image showing each color of red, green and blue as a strip having brightness from 0 to 255 in sequence.

In one of the embodiments, the standard image of the gradient tricolor may include a plurality of strips having different brightness values, and the recording unit for invisible gradient lines may further include:

an acquiring unit, configured to acquire an observed image of the standard image of the gradient tricolor displayed on the display;

a detection unit, configured to detect the brightness value of each of the plurality of strips of the observed image;

a brightness difference determination unit, configured to determine a brightness difference between the brightness value of one strip of the plurality of strips of the observed image and the brightness value of an adjacent strip of the one strip;

a comparing unit, configured to compare the brightness difference to a predetermined threshold value; and a border line determination unit, configured to define a border line between the one strip and the adjacent strip as the invisible gradient line when the brightness difference is less than the predetermined threshold value.

In one of the embodiments, the step of determining the optimal Gamma parameters for the tricolor based on a pre-set number of invisible gradient lines may include: setting the optimal Gamma parameters for the tricolor to be the Gamma values for the tricolor corresponding to the standard image of gradient tricolor in which the number of invisible gradient lines is equal to or less than the pre-set number of invisible gradient lines.

In one of the embodiments, a displaying device is provided, which may include:

a brightness obtaining unit, configured to obtain the brightness of the displaying device;

a Gamma parameter obtaining unit, configured to obtain optimal Gamma parameters for a tricolor corresponding to the brightness from a display chip wherein the optimal Gamma parameter is recorded based on a comparison result between a number of invisible gradient lines in a standard image of gradient tricolor and a pre-set number of invisible gradient lines; and a displaying calibration unit, configured to calibrate the display of the displaying device based on the optimal Gamma parameters for the tricolor.

The method for determining the Gamma parameters for a display described herein calibrates the display of the standard image of gradient tricolor with multiple different Gamma values, which can obtain the optimal displaying results based on different calibration results. The optimal Gamma parameters for the tricolor corresponding to the brightness, which represent the optimal displaying results, are obtained based on the calibration results. By calibrating the displaying results of the displaying device with optimal Gamma parameters for the tricolor, the image quality is promoted to best represent the display quality of the displaying device.

DETAILED DESCRIPTION

To facilitate understanding the present disclosure, it will be described hereinafter more thoroughly in reference with the relative accompanying drawings. The preferred embodiments of the present disclosure are provided in the accompanying drawings. However, the present disclosure may be implemented in various forms, and not limited in the embodiments described herein. In contrast, the objective of providing these embodiments is to understand the disclosed description of the present disclosure more thoroughly.

All technical and scientific terms as used herein have the same meaning as commonly understood by those skilled in the art, unless those defined otherwise in context. The terms as used herein in the description of the present disclosure are for the purpose of describing particular embodiments only, and are not intended to be limiting of the present disclosure. The term "and/or" as used herein includes arbitrary and all combinations of one or more of the associated listed items.

For purpose of briefly description, the term "invisible gradient line" as used in the present disclosure refers to a gradient line that exists, but not perceivable by a human eye.

Particularly, as well known, all display devices are used for being observed primarily by human eyes. However, the range of the perceivable wave lengths to a human eye is limited due to the physiological characteristics of human eyes. For example, a human eye is sensitive in respect to the range of wave lengths from 494 nm (cyan) to 585 nm (yellow) under the same brightness condition, while is capable of feeling a minor difference in tints barely in the purple region from 397 nm to 430 nm and in the red region from 655 nm to 760 nm at the edge region of the spectrum. Therefore, in one of the embodiments of the present disclosure, a method for determining Gamma parameters for a display for a tricolour is provided.

Figure 1:
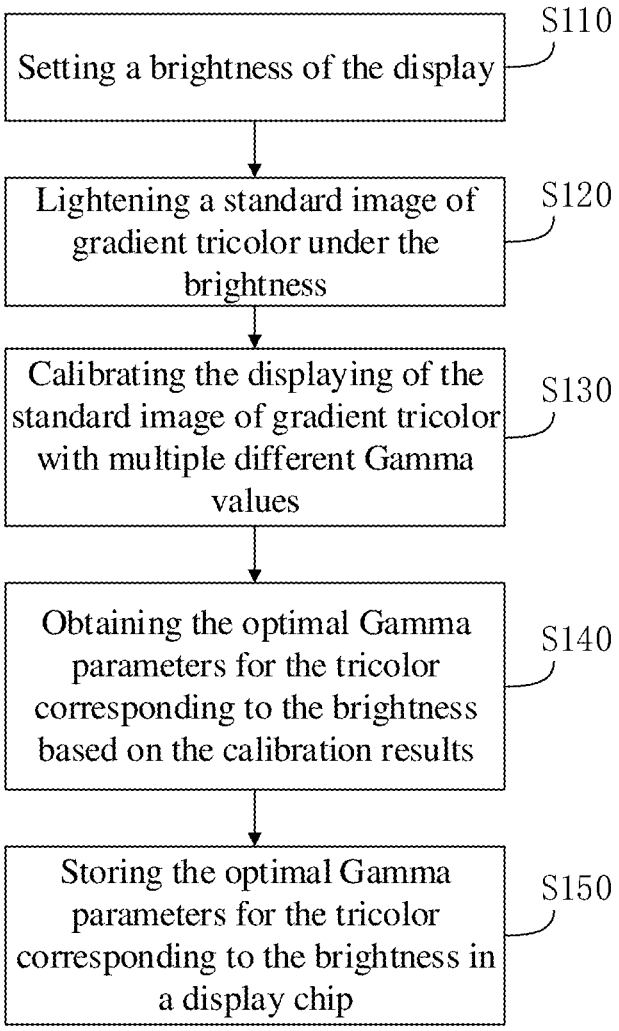
FIG. 1 shows a flow chart of the method for determining Gamma parameters for a display according to one of the embodiments.

In one of the embodiments, as shown in FIG. 1, a method for determining Gamma parameters for a display is provided, including the following steps.

Step S110, set is a brightness of the display.

When the brightness of a display is altered, the Gamma value of the display must change accordingly to achieve the optimal displaying results. In this embodiment, the display screen is calibrated with multiple different Gamma values in order to select the optimal Gamma parameters corresponding to the brightness.

Step S120, lightened is a standard image of gradient tricolor under the brightness.

Figure 2A:
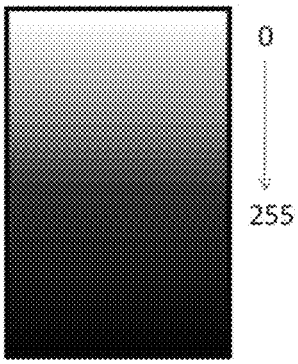
FIGS. 2*a*-2*c* are schematic diagrams of standard images of gradient tricolor (red, green, and blue), respectively, according to one of the embodiments.
Figure 2B:
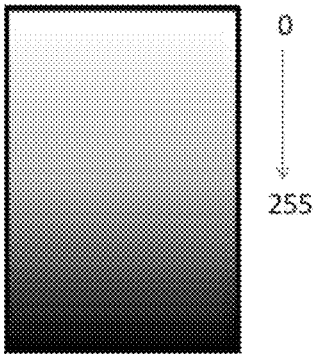
Figure 2C:
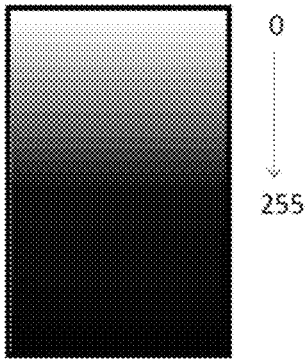

As shown in FIGS. 2*a* to 2*c*, a standard image of gradient tricolor is an image showing each color of red (FIG. 2*a*), green (FIG. 2*b*), and blue (FIG. 2*c*) as a strip having brightness from 0 to 255 in sequence. By way of example, in reference with FIG. 2*a*, there are 256 strips in red provided in the image with different brightness values, while the brightness of each strip is increased by 1 sequentially from 0 to 255. In this embodiment, the gradient image of tricolor is calibrated under multiple different Gamma values. Displaying results are recorded by recording the number of invisible gradient lines. To apply pre-set displaying results, the Gamma value corresponding to a specific number of invisible gradient lines is selected.

Figure 3:
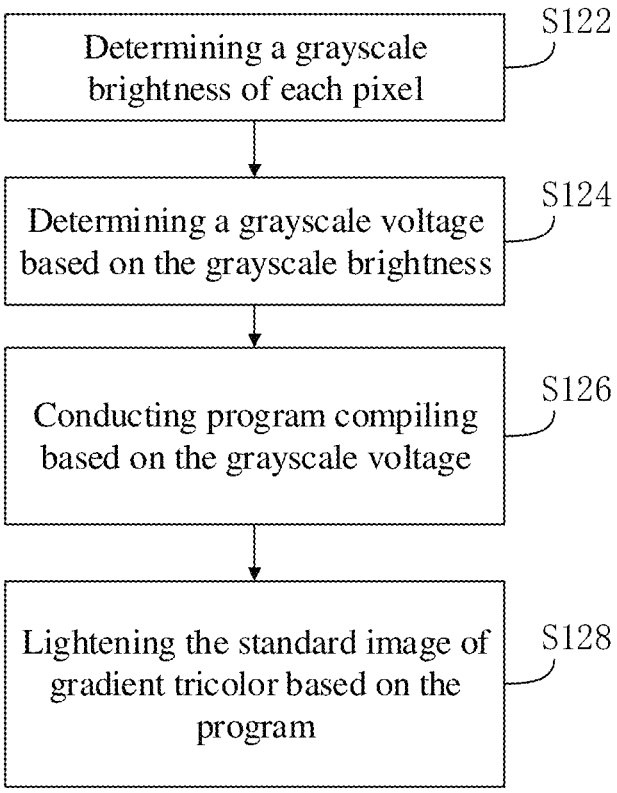
FIG. 3 shows a flow chart for lightening the standard images of the gradient tricolor under the brightness shown in FIG. 1.

In a specific embodiment, as shown in FIG. 3, lightening a standard image of gradient tricolor under the brightness including:

Step S122, determined is the grayscale for each pixel.

A standard image of gradient tricolor by nature is an image showing strips of pixels arranged in sequence by the gray scale from 0 to 255, which is used to fully reveal the color resolution of a display.

Step S124, determined is a grayscale voltage based on the grayscale brightness.

The grayscale brightness is converted to grayscale voltage in order for a display to display the image.

Step S126, conducted is program compiling based on the grayscale voltage.

The display control circuit is typically driven and controlled by a specific chip, wherein the drive program needs to be compiled based on the grayscale voltage of the pixels.

Step 128, lightened is the standard image of gradient tricolor based on the program.

Displaying on a display can be achieved by applying a variety of grayscale voltages to the display via the compiled program. Lightening the display may be implemented usually using the method of matrix scanning drive circuit. A matrix scanning drive circuit includes row electrodes that link the back electrodes of a horizontal group of pixels and column electrodes that link the back electrodes of a vertical group of pixels. In a row of light-emitting pixels, columns needed in the current light emitting are connected to positive electrode, while columns not needed in light emitting are grounded. When the corresponding row electrode is grounded, the row pixels that are connected to positive electrodes all emit light, while the grounded pixels on the same row do not. This method is similar to CRT raster scanning, which periodically applies selective pulses to row electrodes while applies selective or non-selective drive pulses to column electrodes accordingly in order to realize the display function of all the display pixels in a row.

Step S130, calibrated is the displaying of the standard image of gradient tricolor with multiple different Gamma values.

There is a non-linear relationship between the input and output signals of the display due to its special photoelectric effect. If the output photo signal of the display has an intensity of L and an input voltage of U, then their relationship can be represented by $L=kU^{\gamma}$, whereas k is a constant and $\gamma$ is the Gamma value of the display. Such a non-linear relationship is called Gamma calibration for a display. Serious distortion of brightness and chromaticity in output images may occur, if no calibration is performed for the input voltage and output photo signal intensity of a display.

Step S140, obtained are the optimal Gamma parameters for the tricolor based on the calibration results.

Gamma calibration is an important process for the display images to reflect the visual information of the original object or image as optimal as possible. Calibration with multiple different Gamma values can realize a variety of displaying results. The optimal Gamma parameters for the tricolor can be obtained based on the Gamma calibration results.

Figure 4:
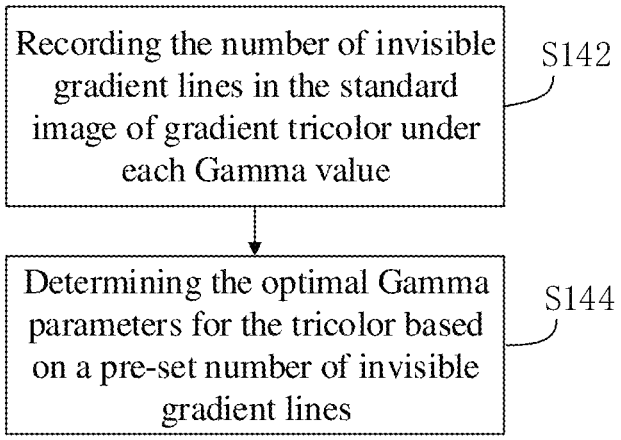
FIG. 4 shows a flow chart for obtaining the optical Gamma parameters for the tricolor corresponding to the brightness based on the calibration results according to a specific embodiment.
Figure 5:
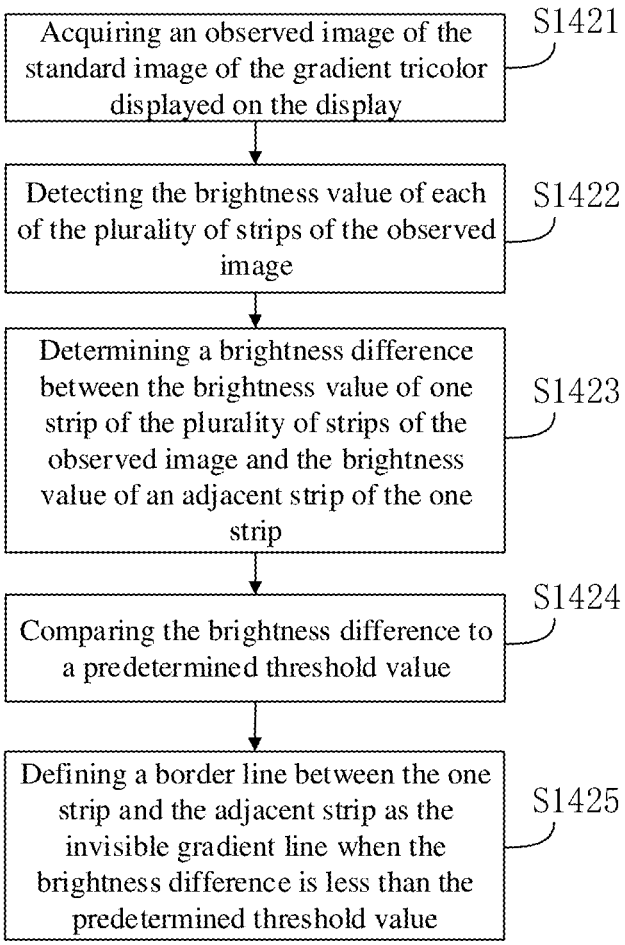
FIG. 5 shows a flow chart for recording the number of invisible gradient lines in the standard image of gradient tricolor under each Gamma value according to one of the embodiments.

In a specific embodiment, as shown in FIG. 4, the step of obtaining the optimal Gamma parameters for the tricolor based on the calibration results may further include the following steps.

Step S142, recorded is the number of invisible gradient lines in the standard image of gradient tricolor under each Gamma value, wherein the invisible gradient line is determined by using image analysis.

As the number of invisible gradient lines in the standard image of gradient tricolor decreases, the resolution scale of a display for each color and the color gamut generated by combining the three colors increase. The displaying results of a display are also related to the number of invisible gradient lines. In one embodiment, the number of invisible gradient lines corresponding to the optimal displaying results may be recorded manually as a reference for the display, i.e. if two adjacent strips from an observed image have such a minor difference in brightness values therebetween, the common border line therebetween may not be perceived by human eyes directly due to the reasons set forth above, the border line is defined then as an invisible gradient line. In contrast, if the difference in brightness values between one strip and an adjacent strip of the one strip is sufficiently large, the common border line therebetween may be perceived by human eyes, so as to be able to determine the number of the visible gradient lines. That is, the number of the invisible gradient lines may be calculated by subtracting the number of the visible gradient lines from the total number of the gradient lines, i.e. 255.

In a preferred embodiment, the number of invisible gradient lines corresponding to the optimal displaying results may be recorded by using image analysis. The standard image of the gradient tricolor may include a plurality of strips having different brightness values, and the image analysis includes the following steps.

Step S1421, acquired is an observed image of the standard image of the gradient tricolor displayed on the display.

Step S1422, detected is the brightness value of each of the plurality of strips of the observed image.

Due to the physiological characteristics of human eyes described above, the brightness value of each of the plurality of strips of an observed image is different to the brightness value of each strip as displayed on the display. In one embodiment, a detection unit, such as a camera, detector, light sensor or the like can be introduced so as to detect the brightness value of each strip in the standard image of the gradient tricolour of the observed image.

Specifically, in one embodiment, a camera may be provided facing towards the center line of each stripe in longitudinal direction to detect the brightness values of each strip in turn.

Step S1423, determined is a brightness difference between the brightness value of one strip of the plurality of strips of the observed image and the brightness value of an adjacent strip of the one strip.

Step S1424, compared is the brightness difference to a predetermined threshold value.

Step S1425, defined is a border line between the one strip and the adjacent strip as the invisible gradient line when the brightness difference is less than the predetermined threshold value.

In one embodiment, the brightness values of one strip of the plurality of strips of the observed image and the brightness value of an adjacent strip of the one strip are respectively compared with each other, so as to determine the difference of the two adjacent strips in the brightness values. In such a way, the differences of each two adjacent strips in brightness values are compared respectively to a predetermined threshold so as to determine whether a border line therebetween an invisible gradient line is or not. That is, when the brightness difference is less than the predetermined threshold value, the border line between the one strip and the adjacent strip is defined as the invisible gradient line.

Specifically, a common border line between one strip and an adjacent strip of the one strip is determined as an invisible gradient line, when the difference of the two adjacent strips in the brightness values is equal to or less than 0.5 cd/m$^2$ under the brightness of the display that is less than 10 cd/m$^2$. On the other hand, a common border line between one strip and an adjacent strip of the one strip is determined as an invisible gradient line, when the difference of the two adjacent strips in the brightness values is equal to or less than 5 cd/m$^2$ under the brightness of the display that is equal to or greater than 10 cd/m$^2$.

Specifically, in one embodiment, if the difference of two adjacent strips in the brightness values which are lightened under the same brightness of the display at 250 cd/m$^2$, is less than 5 cd/m$^2$, than the common border line between the both is defined as an invisible gradient line.

Additionally, since the colour coordinates of strips contribute to the perception of human eyes and may also change slightly in the standard image of gradient tricolor in practice due to the display characteristics of a display, the colour coordinate of each strip may be also then detected and compared in addition to the observation brightness values. By way of the example described above, if a difference between two adjacent strips in the brightness values is less than 5 cd/m$^2$ under the brightness of the display that is equal to or greater than 10 cd/m$^2$, such like 250 cd/m$^2$, and a difference in the color coordinates therebetween is less than 0.05, the common border line therebetween is defined then as the invisible gradient line. In another embodiment, if a difference between two adjacent strips in the brightness values is less than 0.5 cd/m$^2$ under the brightness of the display that is less than 10 cd/m$^2$, and a difference in the color coordinates therebetween is less than 0.1, the common border line therebetween is defined then as the invisible gradient line.

S144, determined are the optimal Gamma parameters for the tricolor based on a pre-set number of invisible gradient lines.

Specifically, to determine the optimal Gamma parameters for the tricolor based on a pre-set number of invisible gradient lines, set the optimal Gamma parameters for the tricolor to be the Gamma values for the tricolor corresponding to the standard image of gradient tricolor in which the number of invisible gradient lines is equal to the pre-set number of invisible gradient lines.

The displaying results of the display are determined manually, and the number of invisible gradient lines corresponding to the optimal displaying results is recorded. This particular number of invisible gradient lines serves as the pre-set number of invisible gradient lines. The optimal Gamma parameters for the tricolor based on different brightness can be determined using such a pre-set number of invisible gradient lines. The number of invisible gradient lines can be determined manually. However, of course, it can also be determined through image analysis to avoid individual variation in manual operations.

Step 150, stored are the optimal Gamma parameters for the tricolor corresponding to the brightness in a display chip.

Lastly, the optimal Gamma parameters for each of the red, green, and blue colors under the brightness is obtained and stored in a display chip. In practice, when the brightness of the display is altered, the optimal Gamma parameters corresponding to the brightness is obtained from the display chip and employed in calibration of the displaying results of the displaying device in order to achieve the optimal displaying results thereof.

The method for determining the Gamma parameters for a display described herein calibrates the display of the standard image of gradient tricolor with multiple different Gamma values, which can obtain the optimal displaying results based on different calibration results. The optimal Gamma parameters for the tricolor corresponding to the brightness, which represent the optimal displaying results, are obtained based on the calibration results. By calibrating the displaying results of the displaying device with optimal Gamma parameters for the tricolor, the image quality is promoted to best represent the display quality of the displaying device.

The method for determining the Gamma parameters for a display described herein determines the optimal Gamma parameters for the tricolor corresponding to the display brightness based on the number of invisible gradient lines in the standard image of gradient tricolor. By calibrating the displaying results of the displaying device with the optimal Gamma parameters for the tricolor, the image quality is promoted to best represent the display quality of the displaying device.

Figure 6:
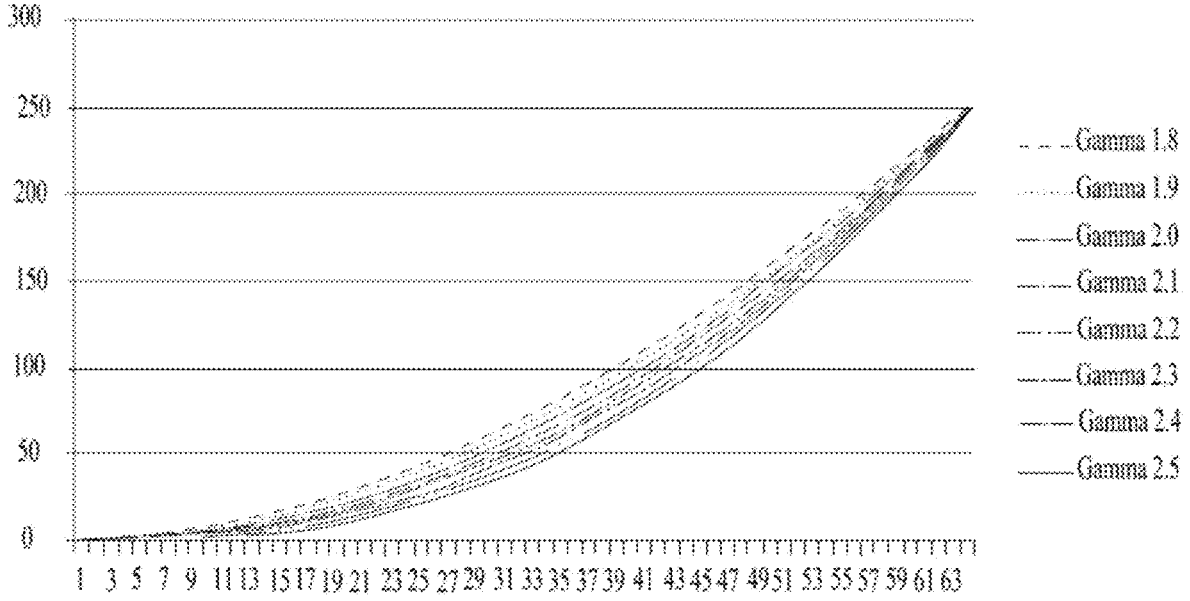
FIG. 6 shows a chart representing the relationship between input signal and output light intensity under the brightness of 250 cd/m$^2$ according to an embodiment.

Some specific embodiments are shown in FIG. 6, whereas the x-axis represents input signal intensity and the y-axis represents output light intensity. The numbers of each of the red, green, and blue invisible gradient lines under the brightness of 250 cd/m$^2$ are recorded for an active-matrix organic display, respectively, where the tri-color Gamma value is 1.8. Similarly, the numbers of each of the red, green, and blue invisible gradient lines are recorded at Gamma values of 1.9, 2.0, 2.1, 2.2, 2.3, 2.4, and 2.5, respectively. The curves from top to bottom in FIG. 6 represents Gamma values of 1.8, 1.9, 2.0, 2.1, 2.2, 2.3, 2.4, and 2.5, respectively.

Figure 7:
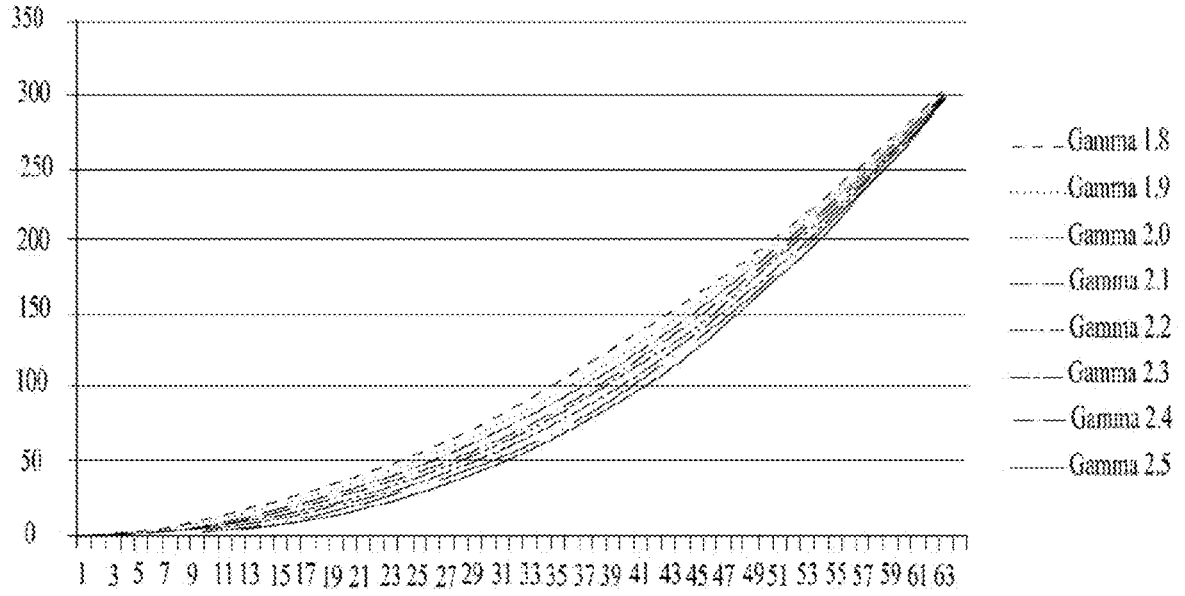
FIG. 7 shows a chart representing the relationship between input signal and output light intensity under the brightness of 300 cd/m$^2$ according to an embodiment.

As shown in FIG. 7, the x-axis represents input signal intensity and the y-axis represents output light intensity. The numbers of each of the red, green, and blue invisible gradient lines under the brightness of 300 cd/m$^2$ are recorded for an active-matrix organic display, respectively, where the tri-color Gamma value is 1.8. Similarly, the numbers of each of the red, green, and blue invisible gradient lines are recorded at Gamma values of 1.9, 2.0, 2.1, 2.2, 2.3, 2.4, and 2.5, respectively. The curves from top to bottom in FIG. 7 represents Gamma values of 1.8, 1.9, 2.0, 2.1, 2.2, 2.3, 2.4, and 2.5, respectively.

Figure 8:
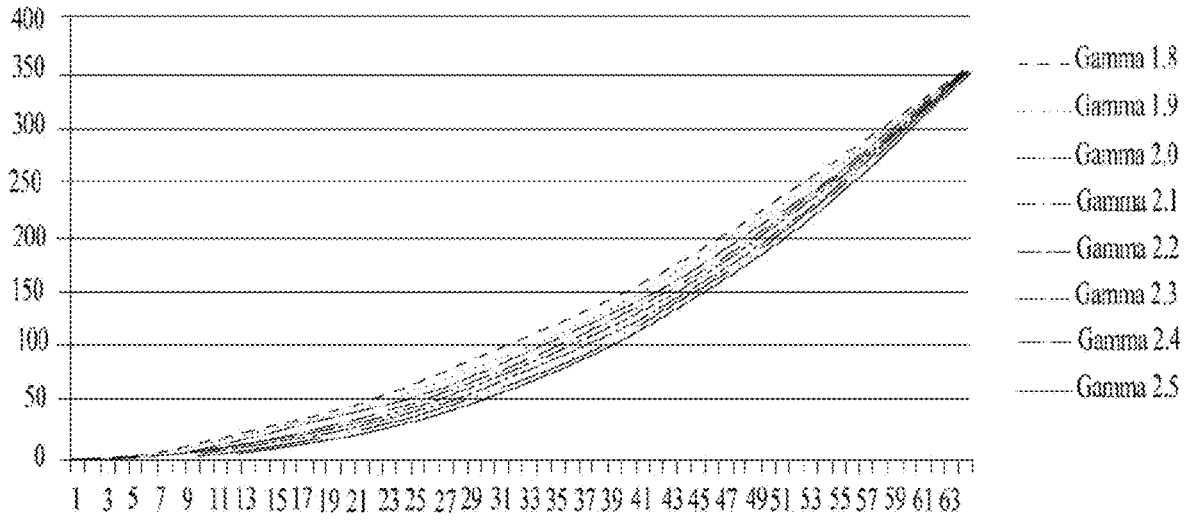
FIG. 8 shows a chart representing the relationship between input signal and output light intensity under the brightness of 350 cd/m$^2$ according to an embodiment.

As shown in FIG. 8, the x-axis represents input signal intensity and the y-axis represents output light intensity. The numbers of each of the red, green, and blue invisible gradient lines under the brightness of 350 cd/m$^2$ are recorded for an active-matrix organic display, respectively, where the tri-color Gamma value is 1.8. Similarly, the numbers of each of the red, green, and blue invisible gradient lines are recorded at Gamma values of 1.9, 2.0, 2.1, 2.2, 2.3, 2.4, and 2.5, respectively. The curves from top to bottom in FIG. 8 represents Gamma values of 1.8, 1.9, 2.0, 2.1, 2.2, 2.3, 2.4, and 2.5, respectively.

Figure 9:
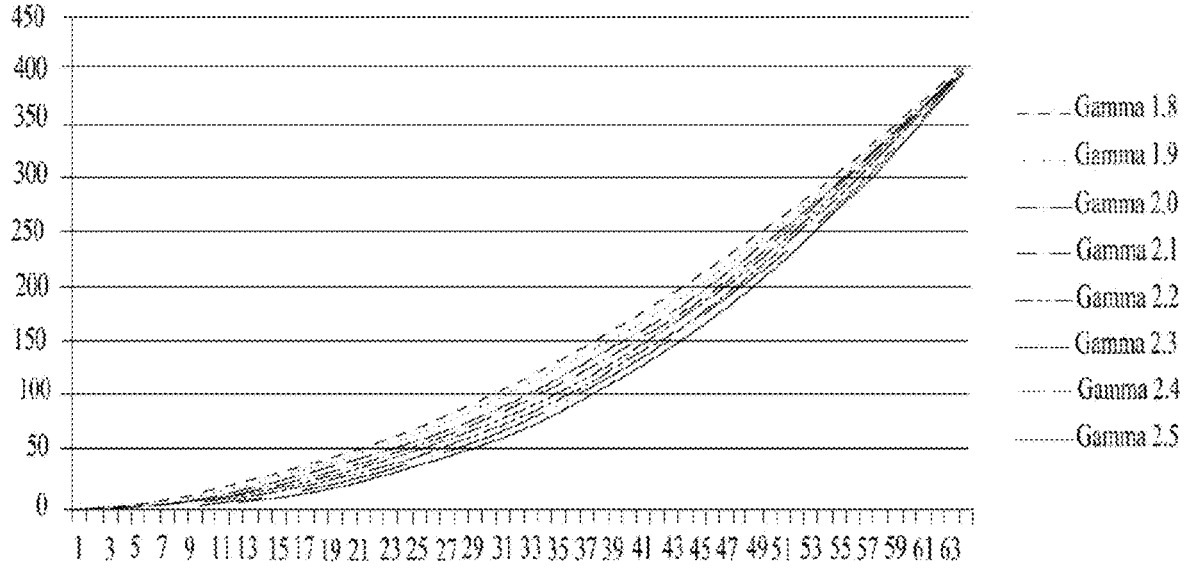
FIG. 9 shows a chart representing the relationship between input signal and output light intensity under the brightness of 400 cd/m$^2$ according to an embodiment.

As shown in FIG. 9, the x-axis represents input signal intensity and the y-axis represents output light intensity. The numbers of each of the red, green, and blue invisible gradient lines under the brightness of 400 cd/m$^2$ are recorded for an active-matrix organic display, respectively, where the tri-color Gamma value is 1.8. Similarly, the numbers of each of the red, green, and blue invisible gradient lines are recorded at Gamma values of 1.9, 2.0, 2.1, 2.2, 2.3, 2.4, and 2.5, respectively. The curves from top to bottom in FIG. 9 represents Gamma values of 1.8, 1.9, 2.0, 2.1, 2.2, 2.3, 2.4, and 2.5, respectively.

Figures 10, 11A:
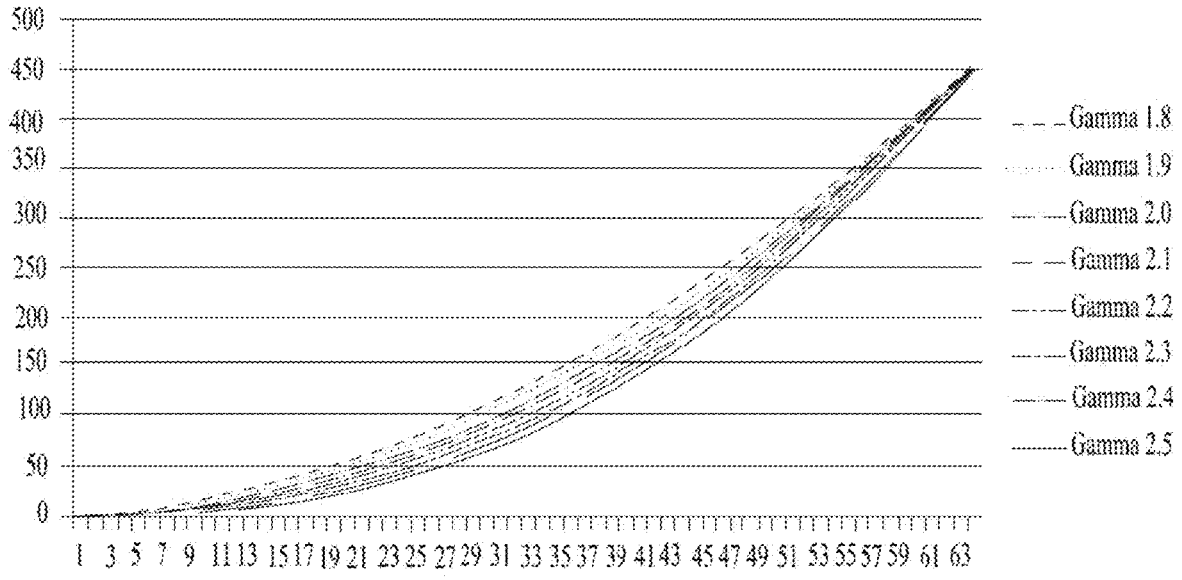
FIG. 10 shows a chart representing the relationship between input signal and output light intensity under the brightness of 450 cd/m$^2$ according to an embodiment.
FIGS. 11*a*-11*b* show the numbers of invisible gradient lines among gradient lines of each of the red, green and blue tricolor under different brightness corresponding to different Gamma values, respectively, on an AMOLED display.

As shown in FIG. 10, the x-axis represents input signal intensity and the y-axis represents output light intensity. The numbers of each of the red, green, and blue invisible gradient lines under the brightness of 450 cd/m$^2$ are recorded for an active-matrix organic display, respectively, where the tri-color Gamma value is 1.8. Similarly, the numbers of each of the red, green, and blue invisible gradient lines are recorded at Gamma values of 1.9, 2.0, 2.1, 2.2, 2.3, 2.4, and 2.5, respectively. The curves from top to bottom in FIG. 10 represents Gamma values of 1.8, 1.9, 2.0, 2.1, 2.2, 2.3, 2.4, and 2.5, respectively.

It can be understood by a person skilled in the art that the range of display brightness in the present application is not in any way limited to be between 250 cd/m$^2$ and 450 cd/m$^2$ and the intervals in between can be narrower. The range of Gamma values described herein is not in any way limited to be between 1.8 and 2.5. The intervals for Gamma values can also be smaller.

Figures 11B, 12:
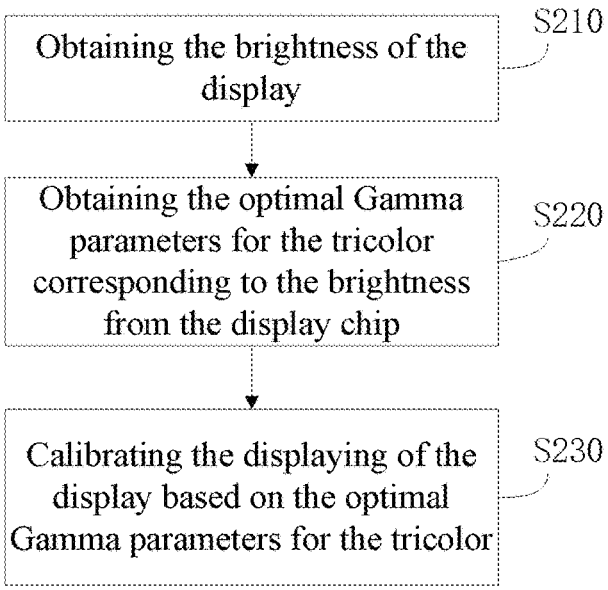
FIG. 12 shows a flow chart of the displaying method for a display according to one of the embodiments.

As shown in FIGS. 11*a* and 11*b*, the optimal Gamma parameters for red, green, and blue colors under certain brightness can be determined based on the displaying results. For example, with invisibility of the six gradient lines as a criterion, at the brightness of 250 cd/m$^2$, let Gamma=2.5 for R fundamental color, Gamma=2.5 for G fundamental color, and Gamma=2.6 for B fundamental color. At the brightness of 300 cd/m$^2$, let Gamma=2.4 for R fundamental color, Gamma=2.4 for G fundamental color, and Gamma=2.5 for B fundamental color. At the brightness of 350 cd/m$^2$, let Gamma=2.1 for R fundamental color, Gamma=2.1 for G fundamental color, and Gamma=2.3 for B fundamental color. At the brightness of 400 cd/m$^2$, let Gamma=2.0 for R fundamental color, Gamma=2.0 for G fundamental color, and Gamma=2.2 for B fundamental color. At the brightness of 450 cd/m$^2$, let Gamma=1.9 for R fundamental color, Gamma=1.9 for G fundamental color, and Gamma=1.9 for B fundamental color.

It would be understood that the pre-set number of invisible gradient lines described herein is not necessarily 6. Different displaying results can be achieved by setting different the pre-set number of invisible gradient lines. The pre-set number of invisible gradient lines may be customized to different values as needed.

Finally, the numbers of each of the red, green, and blue invisible gradient lines corresponding to different Gamma values for an AMOLED display may be recorded in a display chip. In use, when the user adjusts the brightness, the optimal Gamma parameters for the tricolor can be obtained according to the brightness, so that the best displaying results can be achieved for the AMOLED display.

In one of the embodiments, as shown in FIG. 12, a displaying method for a displaying device is provided, including the following steps.

Step S210, obtained is the display brightness.

By obtaining the display brightness and the corresponding optimal Gamma parameters, the best displaying results can be achieved.

S220, obtained are the optimal Gamma parameters for the tricolor corresponding to the brightness from the display chip.

The optimal Gamma parameters for the tricolor corresponding to the brightness are determined based on the number of invisible gradient lines in the standard image of gradient tricolor. More specifically, it may include the following steps: lightening the standard image of gradient tricolor under the brightness; calibrating the displaying of the standard image of gradient tricolor with multiple different Gamma values; and obtaining the optimal Gamma parameters for the tricolor corresponding to the brightness based on the calibration results.

The step of obtaining the optimal Gamma parameters for the tricolor corresponding to the brightness based on the calibration results may include: recording the number of invisible gradient lines in the standard image of gradient tricolor under each Gamma value; and determining the optimal Gamma parameters for the tricolor based on a pre-set number of invisible gradient lines. The method for determining an invisible gradient line already set forth above, thus it will not be described here repeatedly. Specifically, the step of determining the optimal Gamma parameters for the tricolor based on a pre-set number of invisible gradient lines may be setting the optimal Gamma parameters for the tricolor to be the Gamma values for the tricolor corresponding to the standard image of gradient tricolor in which the number of invisible gradient lines is equal to the pre-set number of invisible gradient lines.

Step S230, calibrated is the displaying of the displaying device based on the optimal Gamma parameters for the tricolor.

The displaying device can be calibrated with the optimal Gamma parameters for the tricolor corresponding to the brightness stored in a display chip in order to generate the best displaying results.

By calibrating the displaying results of the displaying device with the optimal Gamma parameters for the tricolor, the image quality is promoted to best represent the display quality of the displaying device.

It should be understood that although all of the steps in the flow diagrams of FIGS. 1, 3-5 and 12 are shown sequentially as the indication of the arrows, these steps do not have to be performed in the sequence as indicated by the arrows. Performing these steps does not have any sequential limitation such that these steps may be performed in another sequence unless it is illustrated explicitly in the context. Further, at least a part of steps of FIGS. 1, 3-5 and 12 may include multiple sub-steps or stages which may be performed at different times rather have to be accomplished at the same time, which may be performed in turn or alternately with the other steps or at least a part of the sub-steps or stages of the other steps, rather unnecessarily to be performed sequentially.

Figure 13:
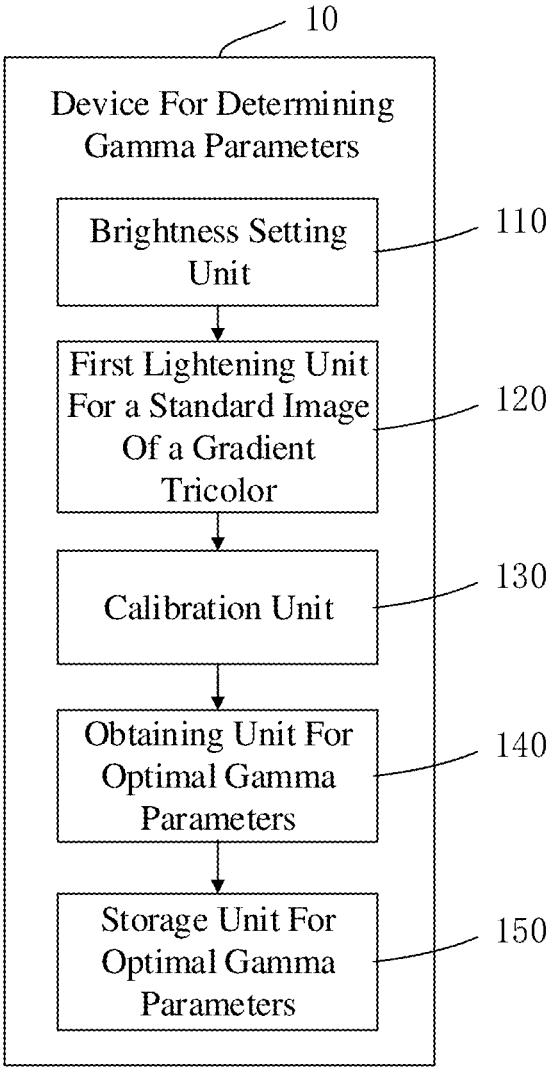
FIG. 13 shows the structural diagram of the device for determining Gamma parameters according to one of the embodiments.

In one of the embodiments, as shown in FIG. 13, a device 10 for determining Gamma parameters for a display, which may include: a brightness setting unit 110; a first lightening unit 120 for a standard image of a gradient tricolor; a calibration unit 130; a obtaining unit 140 for optimal Gamma parameters for the tricolor; and a storage unit 150 for optimal Gamma parameters for the tricolor.

The brightness setting unit 110 is configured to set the brightness of the display. The first lightening unit 120 for a standard image of a gradient tricolor is configured to lighten a standard image of gradient tricolor under the brightness. The standard image of gradient tricolor is an image showing each color of red, green and blue as a strip having brightness arranged successively from 0 to 255 in sequence. The calibration unit 130 is configured to calibrate the display of the standard image of gradient tricolor with multiple different Gamma values. The obtaining unit 140 for optimal Gamma parameters for the tricolor is configured to obtain the optimal Gamma parameters for the tricolor corresponding to the brightness based on the calibration results. The storage unit 150 for optimal Gamma parameters for the tricolor is configured to store the optimal Gamma parameters for the tricolor corresponding to the brightness in a display chip.

The device 10 for determining the Gamma parameters for a display described herein calibrates the display of the standard image of gradient tricolor with multiple different Gamma values, which can obtain the optimal displaying results based on different calibration results. The optimal Gamma parameters for the tricolor corresponding to the brightness, which represent the optimal displaying results, are obtained based on the calibration results.

Figure 14:
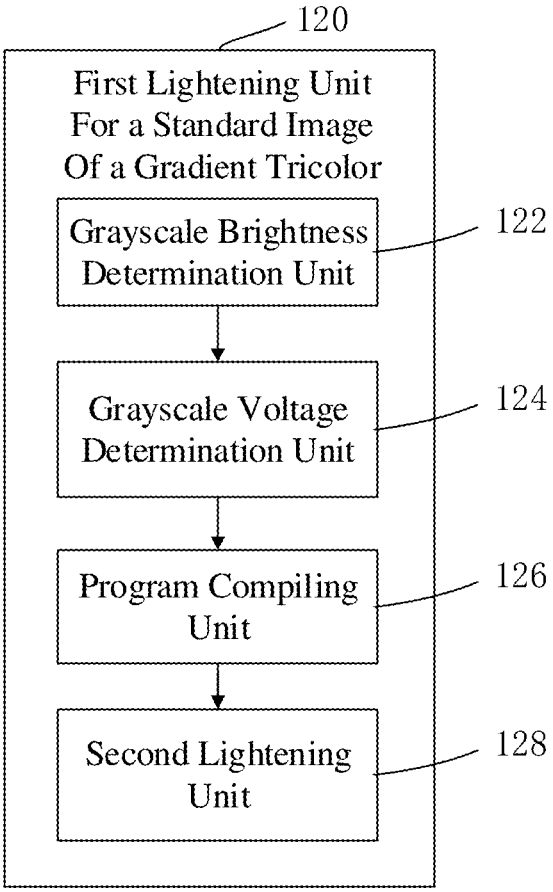
FIG. 14 shows the structural diagram of the first lightening unit for a standard image of a gradient tricolor shown in FIG. 13.

In one of the embodiments, as shown in FIG. 14, the first lightening unit 120 for a standard image of a gradient tricolor may include: a grayscale brightness determination unit 122; a grayscale voltage determination unit 124; a program compiling unit 126; and a second lightening unit 128.

The grayscale brightness determination unit 122 is configured to determine the grayscale brightness of each pixel. The grayscale voltage determination unit 124 is configured to determine the grayscale voltage based on the grayscale brightness. The program compiling unit 126 is configured to conduct program compiling based on the grayscale voltage. The second lightening unit 128 is configured to lighten the standard image of gradient tricolor based on the program. Lightening the display may be implemented usually with the method of matrix scanning drive circuit. A matrix scanning drive circuit includes row electrodes that link the back electrodes of a horizontal group of pixels and column electrodes that link the back electrodes of a vertical group of pixels. In a row of light-emitting pixels, columns needed in the current light emitting are connected to positive electrode, while columns not needed in light emitting are grounded. When the corresponding row electrode is grounded, the row pixels that are connected to positive electrodes all emit light, while the grounded pixels on the same row do not. This method is similar to CRT raster scanning, which periodically applies selective pulses to row electrodes while applies selective or non-selective drive pulses to column electrodes accordingly in order to realize the display function of all the display pixels in a row.

Figure 15:
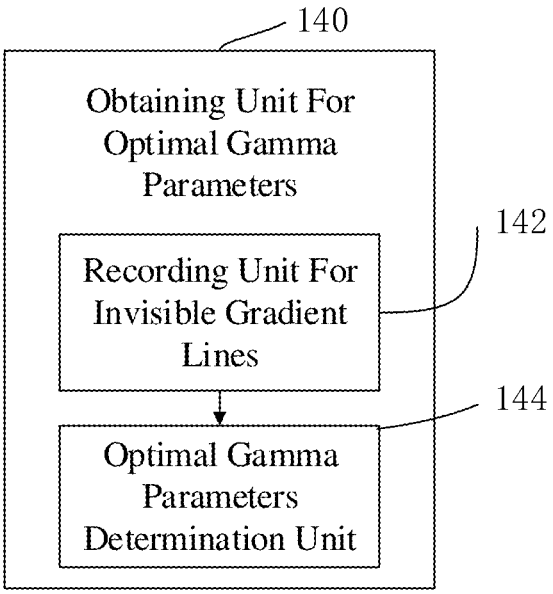
FIG. 15 shows the structural diagram of the obtaining unit for optimal Gamma parameters shown in FIG. 13.

In one of the embodiments, as shown in FIG. 15, the obtaining unit 140 for optimal gamma parameters may include: a recording unit 142 for invisible gradient lines; and a optimal Gamma parameters determination unit 144.

The recording unit 142 for invisible gradient lines is configured to record the number of invisible gradient lines under each Gamma value. The optimal Gamma parameters determination unit 144 for the tricolor is configured to determine the optimal Gamma parameters for the tricolor based on a pre-set number of invisible gradient lines. Specifically, the optimal Gamma parameters determination unit 144 may set the optimal Gamma parameters for the tricolor to be the Gamma values of the standard image of gradient tricolor in which the number of invisible gradient lines is equal to the pre-set number of invisible gradient lines as the optimal Gamma parameters for the tricolor.

Figure 16:
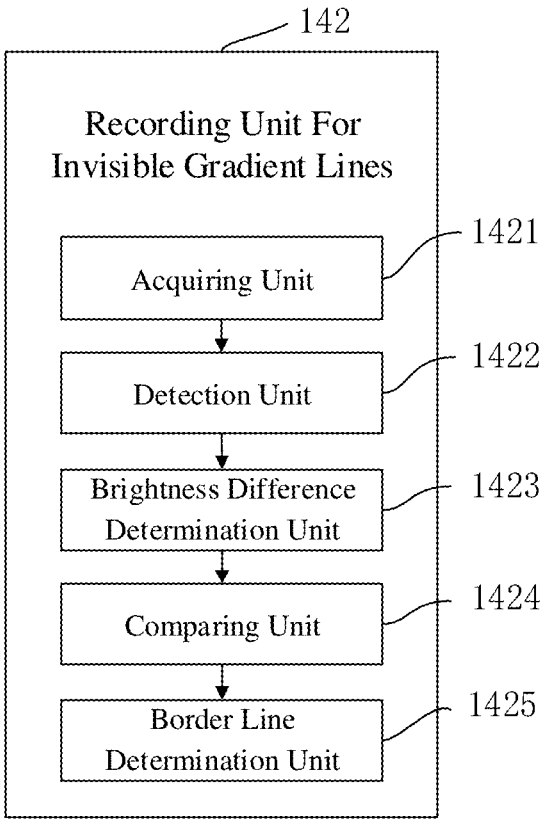
FIG. 16 shows the structural diagram of the recording unit for invisible gradient lines.

In one of the embodiments, as shown in FIG. 16, the recording unit 142 for invisible gradient lines may further include an acquiring unit 1421, a detection unit 1422, a brightness difference determination unit 1423, a comparing unit 1424 and a border line determination unit 1425. The acquiring unit 1421 is configured to acquire an observed image of the standard image of the gradient tricolor displayed on the display. The detection unit 1422 is configured to detect the brightness value of each of the plurality of strips of the observed image. The brightness difference determination unit 1423 is configured to determine a brightness difference between the brightness value of one strip of the plurality of strips of the observed image and the brightness value of an adjacent strip of the one strip. The comparing unit 1424 is configured to compare the brightness difference to a predetermined threshold value. The border line determination unit 1425 is configured to define a border line between the one strip and the adjacent strip as the invisible gradient line when the brightness difference is less than the predetermined threshold value.

Figure 17:
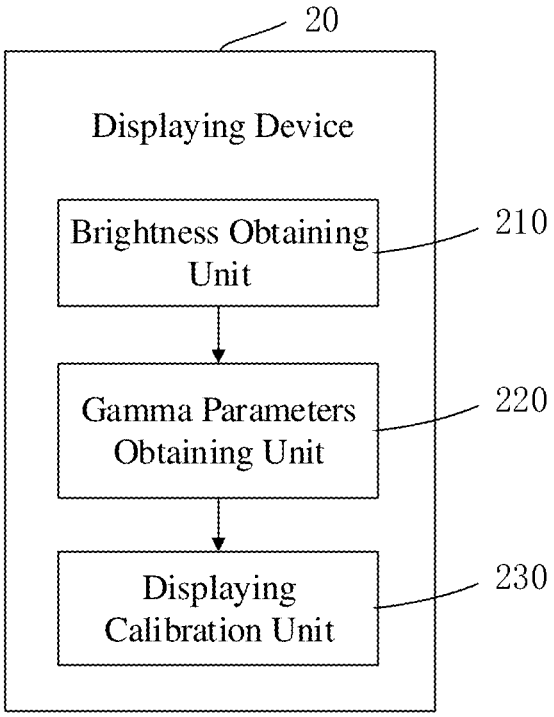
FIG. 17 shows the structural diagram of the displaying device according to one of the embodiments.

In one of the embodiments, as shown in FIG. 17, a displaying device 20 is provided, which may include: a brightness obtaining unit 210; a Gamma parameter obtaining unit 220; and a displaying calibration unit 230.

The brightness obtaining unit 210 is configured to obtain the brightness of the displaying device. The Gamma parameter obtaining unit 220 is configured to obtain the optimal Gamma parameters for the tricolor corresponding to the brightness from the display chip. The displaying calibration unit 230 is configured to calibrate the display of the displaying device based on the optimal Gamma parameters for the tricolor. Specifically, the optimal Gamma parameters for the tricolor corresponding to the brightness are determined based on the number of invisible gradient lines in the standard image of gradient tricolor. The displaying device 20 as described herein obtains the optimal Gamma parameters corresponding to the brightness via the Gamma parameter obtaining unit 220, and calibrates the displaying results of the displaying device via the calibration unit 230, promoting the image quality to represent the display quality of the displaying device.

Figure 18:
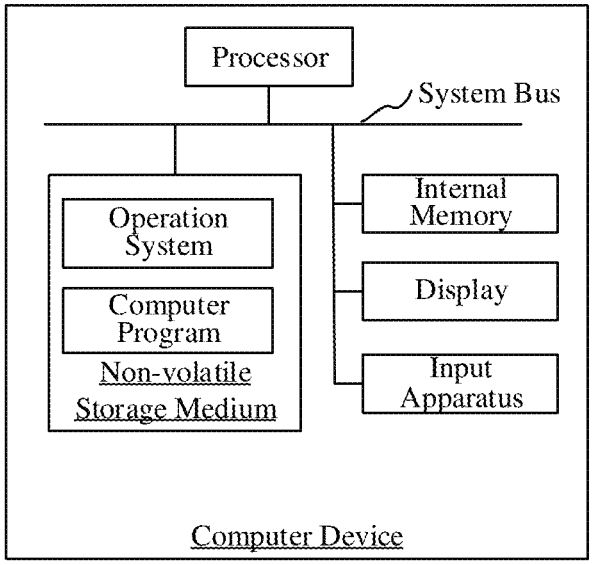
FIG. 18 shows an internal structural diagram illustrating a computer apparatus in one embodiment.

In one embodiment, a computer apparatus is provided. The internal structural diagram of the computer apparatus is shown in FIG. 18. The computer apparatus includes a processor, a memory, a display and an input apparatus connected via a system bus. The processor of the computer apparatus herein is configured to provide calculation and control abilities. The memory (including the device chip) of the computer apparatus includes a non-transitory storage medium and a Random Access Memory (RAM). The non-transitory storage medium has an operating system and a computer program stored therein. The RAM provides an operation environment for the operating system and the computer program in the non-transitory storage medium. The method for determining Gamma parameters is implemented when the computer program is executed by the processor. The display of the computer apparatus may be a liquid crystal display or an E-ink display. The input device of the computer apparatus may be a touch layer covered on the display, or may be a button, a trackball or a touch pad provided on the housing of the computer apparatus, or further may be a peripheral keyboard, a touch pad, a mouse or the like. Those skilled in the art should understand that the configuration shown in FIG. 18 is a block diagram of a partial configuration related to the solutions of the disclosure only, and does not constitute a limitation to the computer apparatus to which the solution of the disclosure is applied, the specific computer apparatus may include more or less parts than those shown in the diagram, or combine certain parts, or have a different arrangement of the parts. In one embodiment, a computer apparatus is provided, which includes a memory, a processor and a computer program stored in the memory and executed in the processor. The following steps are implemented when the processor executes the computer program:

setting a brightness of the display;

lightening a standard image of a gradient tricolor under the brightness;

calibrating the displaying of the standard image of the gradient tricolor with multiple different Gamma values;

obtaining optimal Gamma parameters for a tricolor corresponding to the brightness based on the calibration results by recording a number of invisible gradient lines in the standard image of the gradient tricolor under each of the Gamma values wherein the invisible gradient line is determined by using image analysis, and determining the optimal Gamma parameters for the tricolor based on a pre-set number of invisible gradient lines; and storing the optimal Gamma parameters for the tricolor corresponding to the brightness in a display chip;

acquiring an observed image of the standard image of the gradient tricolor displayed on the display;

detecting the brightness value of each of the plurality of strips of the observed image;

determining a brightness difference between the brightness value of one strip of the plurality of strips of the observed image and the brightness value of an adjacent strip of the one strip;

comparing the brightness difference to a predetermined threshold value; and defining a border line between the one strip and the adjacent strip as the invisible gradient line when the brightness difference is less than the predetermined threshold value;

determining a grayscale brightness of each pixel;

determining a grayscale voltage based on the grayscale brightness;

conducting program compiling based on the grayscale voltage; and lightening the standard image of the gradient tricolor based on the program.

In one embodiment, a computer readable storage medium is provided, on which a computer program is stored. The following steps are implemented when the computer program is executed by the processor:

setting a brightness of the display;

lightening a standard image of a gradient tricolor under the brightness;

calibrating the displaying of the standard image of the gradient tricolor with multiple different Gamma values;

obtaining optimal Gamma parameters for a tricolor corresponding to the brightness based on the calibration results by recording a number of invisible gradient lines in the standard image of the gradient tricolor under each of the Gamma values wherein the invisible gradient line is determined by using image analysis, and determining the optimal Gamma parameters for the tricolor based on a pre-set number of invisible gradient lines; and storing the optimal Gamma parameters for the tricolor corresponding to the brightness in a display chip;

acquiring an observed image of the standard image of the gradient tricolor displayed on the display;

detecting the brightness value of each of the plurality of strips of the observed image;

determining a brightness difference between the brightness value of one strip of the plurality of strips of the observed image and the brightness value of an adjacent strip of the one strip;

comparing the brightness difference to a predetermined threshold value; and defining a border line between the one strip and the adjacent strip as the invisible gradient line when the brightness difference is less than the predetermined threshold value;

determining a grayscale brightness of each pixel;

determining a grayscale voltage based on the grayscale brightness;

conducting program compiling based on the grayscale voltage; and lightening the standard image of the gradient tricolor based on the program.

Those skilled in the art may appreciate that the implementation of all or a part of the processes in the method of the embodiments described above may accomplished by hardware instructed by computer programs, which may be stored in one non-transitory computer readable storage medium. When the computer programs are executed, it is possible to include the processes of the embodiments of each method described above. Any denotation of memory, storage, data base or other media used in the embodiments provided in the present disclosure may include non-transitory and/or transitory memory. The non-transitory memory may include read-only memory (ROM), programmable read-only memory (PROM), electrically programmable read-only memory (EPROM), electrically erasable programmable read-only memory or flash. The transitory memory may include random access memory (RAM) or external cache memory. By way of illustration, but not limitation, RAM may be available in various forms, e.g. Static RAM (SRAM), Dynamic RAM (DRAM), Synchronous DRAM (SDRAM), Double Data Rate SDRAM (DDRSDRAM), Enhanced SDRAM (ESDRAM), Synchlink DRAM (SLDRAM), Rambus Direct RAM (RDRAM), Direct Rambus DRAM (DRDRAM), and Rambus DRAM etc.

Technical features of the above embodiments may be combined arbitrarily. For brief description, not all of the possible combinations of the technical features of the above embodiments are described, but it will be appreciated that these possible combinations fall within the scope of the present disclosure once there is no conflict between the technical features.

The above embodiments are merely illustrative of several embodiments of the disclosure, and the description thereof is more specific and detailed, but should not be deemed as limitations to the scope of the present disclosure. It should be noted that variations and improvements will become apparent to those skilled in the art to which the present disclosure pertains without departing from its scope. Therefore, the scope of the present disclosure is defined by the appended claims.

What is claimed is:

1. A method for determining an optimal Gamma parameter of a display, the method comprising:

setting a brightness level of the display;

lightening a standard image of a gradient tricolor under the brightness level;

calibrating the display with at least one of multiple different Gamma values;

determining a number of invisible gradient lines in the standard image under one of the Gamma values by using image analysis based on the step of calibrating;

obtaining an optimal Gamma parameter for the tricolor corresponding to the brightness level based on the step of calibrating by comparing the number of the invisible gradient lines to a pre-set number of invisible gradient lines; and storing the optimal Gamma parameter for the tricolor corresponding to the brightness level in a display chip, wherein the step of determining a number of invisible gradient lines in the standard image under one of the Gamma values by using image analysis includes:

acquiring an observed image of the standard image displayed on the display;

detecting, by a detection unit, a brightness value of each of strips of the observed image;

determining a brightness difference between the brightness value of one of the strips of the observed image and the brightness value of another of the strips adjacent to the one of the strips;

comparing the brightness difference to a predetermined threshold value; and defining a border line between the one of the strips and the other one of the strips adjacent to the one of the strips as one of the invisible gradient lines when the brightness difference is less than the predetermined threshold value.

2. The method as claimed in claim 1, wherein the standard image is an image showing each color of red, green and blue as strips, wherein each strip has a brightness value from 0 to 255 in sequence.

3. The method as claimed in claim 2, wherein the predetermined threshold value is equal to or less than 5 cd/m$^2$.

4. The method as claimed in claim 1, wherein the step of lightening a standard image of the gradient tricolor under the brightness level comprises:

determining a grayscale brightness of each pixel;

determining a grayscale voltage based on the grayscale brightness;

conducting program compiling based on the grayscale voltage; and lightening the standard image based on the program.

5. The method as claimed in claim 1, wherein the step of obtaining an optimal Gamma parameter for the tricolor corresponding to the brightness level includes setting the Gamma value corresponding to the standard image as the optimal Gamma parameter for the tricolor corresponding to the brightness level when the number of invisible gradient lines is equal to or less than the pre-set number of invisible gradient lines.

6. The method as claimed in claim 5, wherein the brightness level is set to any one of 250 cd/m$^2$, 300 cd/m$^2$, 350 cd/m$^2$, 400 cd/m$^2$, and 450 cd/m$^2$, and the Gamma value is set to be any one of 1.8, 1.9, 2.0, 2.1, 2.2, 2.3, 2.4, and 2.5 under the brightness level, and the pre-set number of invisible gradient lines is 6.

7. A computer apparatus for determining an optimal Gamma parameter of a display, comprising:

a memory with a program stored therein; and a processor in communication with the memory and adapted to execute the program to cause the processor to:

set brightness level of the display;

lighten a standard image of a gradient tricolor under the brightness level;

calibrate the display with at least one of multiple different Gamma values;

determine a number of invisible gradient lines in the standard image under one of the Gamma values by using image analysis based on the calibrating;

obtain the optimal Gamma parameter for the tricolor corresponding to the brightness level based on the calibration by comparing the number of the invisible gradient lines to a pre-set number of invisible gradient lines; and store the optimal Gamma parameter for the tricolor corresponding to the brightness level in a display chip, wherein the step of determining a number of the invisible gradient lines in the standard image under one of the Gamma values by using image analysis comprises:

acquiring an observed image of the standard image displayed on the display;

detecting, by a detection unit, a brightness value of each of the strips of the observed image;

determining a brightness difference between the brightness value of one of the strips of the observed image and the brightness value of another of the strips adjacent to the one of the strips;

comparing the brightness difference to a predetermined threshold value; and defining a border line between the one of the strips and the other one of the strips adjacent to the one of the strips as one of the invisible gradient lines when the brightness difference is less than the predetermined threshold value.

8. The computer apparatus as claimed in claim 7, wherein the standard image is an image showing each color of red, green and blue as strips, wherein each strip has a brightness value from 0 to 255 in sequence.

9. The computer apparatus as claimed in claim 7, wherein the program is further adapted to cause the processor to:

determine a grayscale brightness of each pixel;

determine a grayscale voltage based on the grayscale brightness;

conduct program compiling based on the grayscale voltage; and lighten the standard image based on the program.

10. The computer apparatus as claimed in claim 7, wherein the Gamma value corresponding to the standard image is the optimal Gamma parameter for the tricolor corresponding to the brightness level, when the number of invisible gradient lines is equal to or less than the pre-set number of invisible gradient lines.

11. A displaying method for a display, comprising:

obtaining a brightness level of the display;

obtaining an optimal Gamma parameter for a gradient tricolor corresponding to the brightness level from a display chip, wherein the optimal Gamma parameter is determined by comparing a number of invisible gradient lines in a standard image of the gradient tricolor under the optimal Gamma parameter to a pre-set number of invisible lines, and the number of invisible gradient lines are determined using image analysis; and calibrating the display based on the optimal Gamma parameter, wherein determining of the number of the invisible gradient lines in the standard image under the optimal Gamma parameter by using image analysis comprises:

acquiring an observed image of the standard image displayed on the display;

detecting, by a detection unit, a brightness value of each of the strips of the observed image;

determining a brightness difference between the brightness value of one of the strips of the observed image and the brightness value of another of the strips adjacent to the one of the strips;

comparing the brightness difference to a predetermined threshold value; and defining a border line between the one of the strips and the other one of the strips adjacent to the one of the strips as one of the invisible gradient lines when the brightness difference is less than the predetermined threshold value.

12. The displaying method as claimed in claim 11, wherein the step of determining the optimal Gamma parameter comprises:

lightening the standard image under the brightness level;

calibrating the display with at least one of multiple different Gamma values;

determining the number of the invisible gradient lines in the standard image under one of the Gamma values by using image analysis based on the calibrating;

determining the optimal Gamma parameter for the tricolor corresponding to the brightness level based on the calibrating by comparing the number of the invisible gradient lines to a pre-set number of invisible gradient lines; and storing the optimal Gamma parameter in the display chip.

13. The displaying method as claimed in claim 11, wherein the standard image is an image showing each color of red, green and blue as strips, wherein each strip has a brightness value from 0 to 255 in sequence.

14. The displaying method as claimed in claim 11, wherein the step of determining the optimal Gamma parameter by comparing the number of the invisible gradient lines in the standard image of the gradient tricolor under the optimal Gamma parameter to the pre-set number of invisible gradient lines comprises setting the Gamma value corresponding to the standard image as the optimal Gamma parameter when the number of invisible gradient lines is equal to or less than the pre-set number of invisible gradient lines.

* * * * *